United States Patent [19]

Meisberger

[11] 3,936,206

[45] Feb. 3, 1976

[54] TUBULAR POLE SLIP JOINT CONSTRUCTION

[75] Inventor: Raymond F. Meisberger, West Chester, Pa.

[73] Assignee: Bruce-Lake Company, Coatesville, Pa.

[22] Filed: Feb. 18, 1975

[21] Appl. No.: 550,373

[52] U.S. Cl. ..... 403/334; 52/726

[51] Int. Cl.[2] ..... E04N 12/08

[58] Field of Search ..... 52/726, 731; 403/334, 383, 403/345, 354, 375; 285/330, 332

[56] References Cited

UNITED STATES PATENTS

| | | | |
|---|---|---|---|
| 3,034,209 | 5/1962 | Bianca et al. | 52/726 |
| 3,071,214 | 1/1963 | Steinbichler | 52/726 |
| 3,865,498 | 2/1975 | Okuto et al. | 52/726 |

*Primary Examiner*—Andrew V. Kundrat
*Attorney, Agent, or Firm*—Smith, Harding, Earley & Follmer

[57] ABSTRACT

A slip joint construction for a tubular pole section of a utility pole such as for electrical transmission or lighting wherein a male portion of a tapered pole section fits telescopically within a female portion of another tapered pole section. The female portion is provided with a back-up strip extending along the long seams thereof. The male portion is provided with slots which extend along the long seams thereof, each slot extending the length of the slip joint. A doubler plate is welded on the inside of the male portion to extend across and along the longitudinal extent of each slot.

10 Claims, 6 Drawing Figures

TUBULAR POLE SLIP JOINT CONSTRUCTION

BACKGROUND OF THE INVENTION

In manufacturing poles used by utility companies for electrical transmission or for lighting it often becomes necessary to make tubular poles in more than one section. This can be dictated by the maximum shipping length or a restricted length due to galvanizing limitations or from other field requirements. One common method for joining the poles is a slip joint. A slip joint is a friction fit wherein two sections of poles are slipped together with the female section being above the male section. Both sections have exactly the same taper so that they will slide together a certain distance and then stop and, at least theoretically, be tight and in contact along the entire length of the joint. The amount of overlap is normally one and one half times the diameter at the point of the slip.

The tubular pole sections are constructed of a pair of half shells joined by welds at two longitudinally extending long seams. It is very important that the welds joining the two welds must achieve complete penetration and be inspected to very stringent criteria. This is because as the pole bends the forces tend to exert a hoop stress against the female section which could cause it to split apart. Should this happen the split could continue up the pole causing the slip joint to open up and the structure would fall.

The way to get a good weld with complete penetration on the two longseam welds is to use a heavy steel back-up strip. This allows welding with high heat input assuring that there will be good fusion at the base of the weld. However, this technique has been impractical when a slip joint was involved since the back-up strip would interfere with the male to female fit. Therefore, it has been necessary to make this weld without a full back-up strip or to remove the back-up strip after welding. Both options are unsatisfactory. In the first case, it is very hard to get a good weld without a back-up strip and much repair is required. In the second case, removing the back-up strip is an onerous task which must be done inside a confined area and is detrimental to the health and safety of the worker as well as being very difficult to do without damaging the original weld.

SUMMARY OF THE INVENTION

It is the general object of the invention to provide a slip joint for tubular pole sections which has improved strength characteristics.

In accordance with the general object of the invention, the slip joint is constructed in a manner which allows the back-up strip to remain intact after it has been welded in position. To this end, the two long seams which join the half shells are each provided with a slot in the male portion of the tubular section. A doubler plate is welded to the inside of the male portion to extend across and along the longitudinal extent of each slot. The female portion is made with a full back-up strip which, in the assembled condition of the slip joint, is received in a slot formed in the male portion.

In addition to the improved strength of the slip joint in accordance with the invention, this slip joint also assures that it is unlikely for a section to exceed its designed slip in the assembled condition. Slip joints of the indicated type are normally designed for a maximum overslip of 10 per cent. It is important that this design standard should not be exceeded, since any hardware or climbing attachments for the pole must be placed such that they will not interfere with one another. The design in accordance with the invention limits any overslip, since the ends of the slots in the male portion limit the distance the pole sections can slide together by coming into contact with the lower ends of the back-up strips. Moreover, this design results in little or no loss of strength in the male section wherein the stresses are not nearly so great since the slip joint is in compression. Also, the male section has added rigidity by the provision of a diaphragm plate which is normally inserted in its leading end in order to seal the section and protect it from internal corrosion.

DETAILED DESCRIPTION OF THE INVENTION

Figure 1:
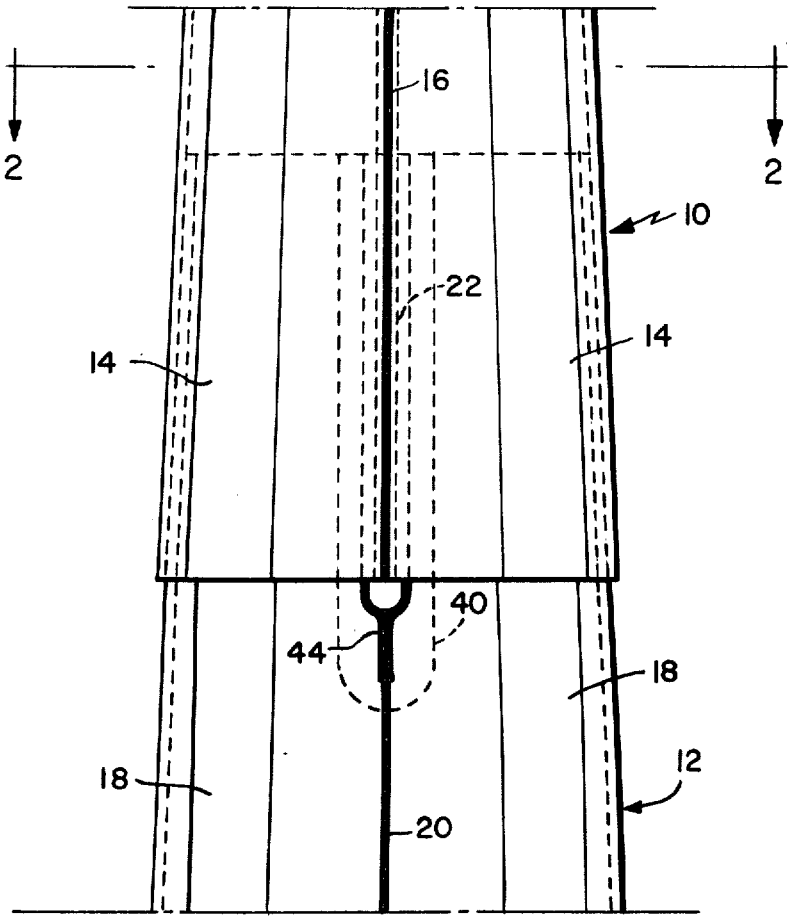
FIG. 1 is a front elevation of a slip joint in accordance with the invention.

In accordance with the preferred embodiment of the invention shown in the drawings, there is provided a pair of tapered tubular pole sections 10 and 12 of a 12 sided tubular steel construction generally conventional in the art. Pole section 10 is made of a pair of half shells 14 welded together at longitudinal seam welds 16. Pole section 12 is made of a pair of half shells 18 welded together at longitudinal seam welds 20.

Figure 2:
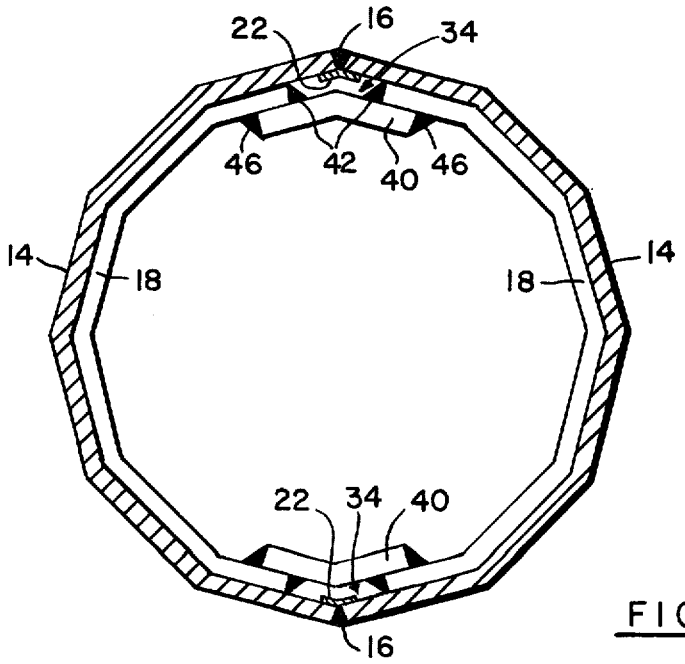
FIG. 2 is a section taken on line 2—2 of FIG. 1.
Figure 4:
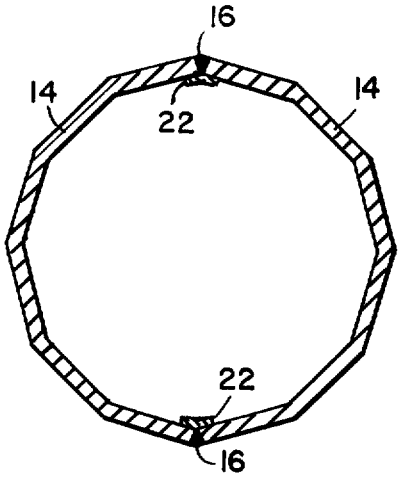
FIG. 4 is a top view of FIG. 3.

The lower portion of pipe section 10 forms the female portion of the slip joint construction shown in FIGS. 1 and 2 and is provided with a pair of back-up strips 22 extending the full length thereof. Each back-up strip 22 is secured to the inside of the pole section 10 by being welded together at longitudinal seam welds 16. This insures that there is complete weld penetration (see FIG. 2) and allows welding with a high heat input so as to insure that there is good fusion at the base of the weld.

Figure 5:
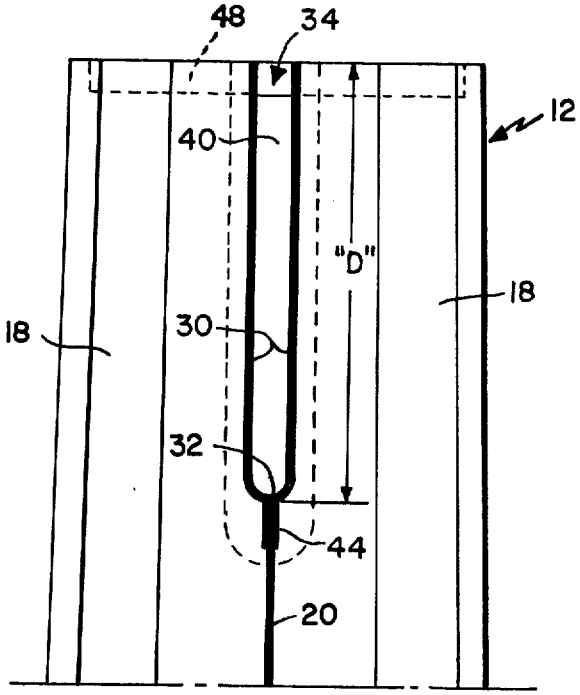
FIG. 5 is a fragmentary view in elevation of the male portion of a tubular pipe section in accordance with the invention.

The upper portion of the pole section 12 forms the male portion of the slip joint shown in FIGS. 1 and 2 and is provided with a pair of slots 30 each located where the half shells 18 would be joined at the upper end of the pole section 12. Each slot 30 extends from the upper end of the pole section 12 longitudinally to a rounded end 32 which is located from the end a distance "D" 10 per cent greater than the design overlap for the slip joint. Thus, the distance D shown in FIG. 5 is 1.1 times the design slip joint length.

A doubler plate 40 is secured on the inside of the pipe section 12 so as to overlap each of the slots 30 and form a recess 34 adapted to receive a back-up strip 22 as shown in FIGS. 1 and 2. Each doubler plate 40 extends from the upper end of the pole section 12 along the length thereof to a location below the end of the associated slot 30 as is best shown in FIG. 5. Each doubler plate 40 is secured to the pole section 14 by a plurality of welds including a fillet weld 42 which extends completely around the edges of an associated slot 30. Each fillet weld 42 joins with a slot weld 44, which extends downwardly from the end 32 of an associated slot 30 a substantial distance and joins with a longitudinal seam weld 20. In addition, each doubler plate 40 is secured to the inside of the pole section 12 by a fillet weld 46 extending around the periphery of the plate. By this arrangement, each doubler plate 40 extends past the length of the slip joint and becomes part of the longitudinal seam weld 20 to thereby transfer stress down into the tubular pole section 12. Moreover, each fillet weld 42 at the bottom end 32 of a slot 30 provides a natural bevel to engage a back-up strip 22 if the slip joint were pulled together a distance that such contact might occur thereby assuring that the joint was tight by forcing the back-up strip 22 outwardly thereby elongating the diameter of the tubular pole section 10. To this end, the lower end of the back-up strip 22 may be beveled so as to assist this result. Each doubler plate 40 is at least equal to the thickness of pole section 12 plus approximately one-eight of an inch.

Figure 6:
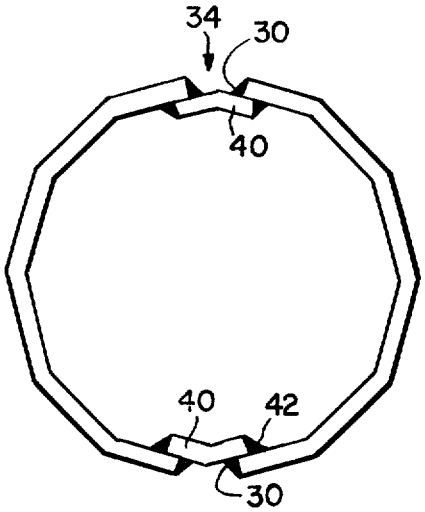
FIG. 6 is a top view of FIG. 5.
Figure 3:
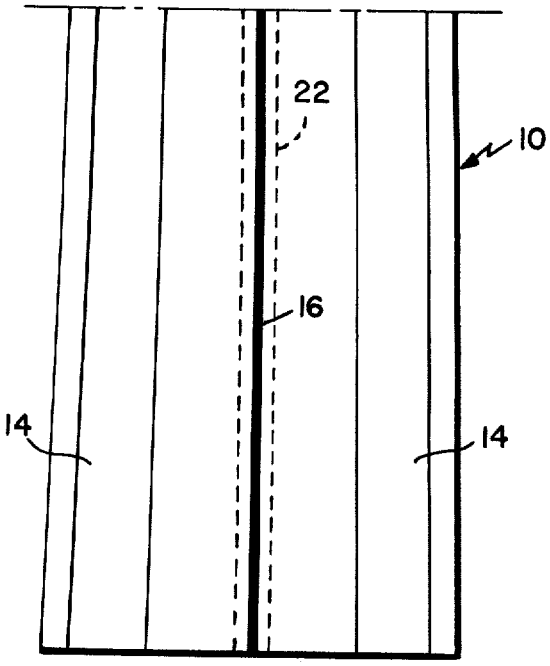
FIG. 3 is a fragmentary view in elevation of the female portion of a tubular pipe section in accordance with the invention.

A diaphragm plate 48 closes the end of pole section 12 and is shown in FIG. 6, but has been omitted from the other Figures for the sake of clarity. Diaphragm plate 48 makes the upper end of pole section 12 more rigid, and seals the pole section and protects it against internal corrosion.

When erecting a pole comprising a joint construction in accordance with the invention, the pole sections 10 and 12 are joined by slipping them together with the female portion slipping over top of the male portion as is shown in FIG. 1. Since both pole sections 10 and 12 have exactly the same taper, they slide together a certain distance and then come into frictional engagement in tight contact along the entire length of the joint. The full-overlap condition is shown in FIG. 1 and the length of overlap is normally about 1½ times the pole diameter at the point of the slip. During the assembly of the pole sections, the back-up strips 22 are slid into the recesses 34 which are adapted to receive them, as is apparent from a consideration of FIGS. 1 and 2. Thus, in the joint construction in accordance with the invention the back-up strips 22 on the pole section 10 do not have to be removed to accept pole section 12. Instead, strips 22 remain intact so as to maintain the maximum strength of the critical female portion of the joint construction.

I claim:

1. In a slip joint construction for a tubular pole useful as a utility pole and having a first tapered tubular pole section constructed of a pair of half shells joined at longitudinal seam welds, a second tapered tubular pole section constructed of a pair of half shells joined at longitudinal seam welds, said first pole section having a male portion at one end thereof, said second pole section having a female portion at one end thereof, said male poriton being adapted to fit telescopically within said female portion with a friction tight slip joint connection, the improvement comprising a back-up strip welded to a longitudinal seam weld of said female section on the inside thereof, a longitudinal slot formed in the end of said male portion aligned with a longitudinal seam weld thereof, and a plate welded on the inside of said male portion and extending across and along the longitudinal extent of said slot to cooperate therewith to form a recess for receiving said back-up strip when the slip joint is made.

2. A slip joint construction according to claim 1 wherein there is provided a back-up strip welded to each longitudinal seam weld of said female section on the inside thereof, a longitudinal slot formed in the end of said male portion aligned with each longitudinal seam weld thereof, and a plate welded on the inside of said male portion and extending across and along the longitudinal extent of each of said slots.

3. A slip joint construction according to claim 2 wherein said plates extend a longitudinal distance beyond the inner end of the longitudinal slot, the longitudinal seam welds of said first pole being welded to said plate portion extending beyond said slot.

4. A slip joint construction according to claim 3 wherein said plates are secured to said first pole section by a fillet weld extending along the edges of each of said slots, said fillet weld being joined with said longitudinal seam welds of said first pole section.

5. A slip joint construction according to claim 4 wherein each of said plates is secured to said first pole section by a second fillet weld extending around the periphery of each plate.

6. A slip joint construction according to claim 2 wherein the thickness of said plates on said first pole section is at least equal to the thickness of said pole section plus approximately one-eighth of an inch.

7. A slip joint construction according to claim 5 wherein the thickness of said plates on said first pole section is at least equal to the thickness of said pole section plus approximately one-eighth of an inch.

8. A slip joint construction according to claim 2 wherein the longitudinal extent of said slots is equal to approximately ten per cent greater than the design slip joint length.

9. A slip joint construction according to claim 5 wherein the longitudinal extent of said slots is equal to approximately ten per cent greater than the design slip joint length.

10. A slip joint construction according to claim 6 wherein the longitudinal extent of said slots is equal to approximately ten per cent greater than the design slip joint length.

* * * * *